US006505527B2

(12) United States Patent
Lu

(10) Patent No.: US 6,505,527 B2
(45) Date of Patent: Jan. 14, 2003

(54) REMOTE-CONTROLLED TOY CAR FORWARD/BACKWARD STEERING CONTROL MECHANISM

(76) Inventor: Ke-Way Lu, 3F, No. 322, Sec. 6, Min-Chuan E. Rd., Taipei City (TW)

( * ) Notice: Subject to any disclaimer, the term of this patent is extended or adjusted under 35 U.S.C. 154(b) by 169 days.

(21) Appl. No.: 09/759,818

(22) Filed: Jan. 11, 2001

(65) Prior Publication Data

US 2002/0090883 A1 Jul. 11, 2002

(51) Int. Cl.[7] ..... F16H 3/04

(52) U.S. Cl. ..... 74/332; 74/342; 74/355; 74/376; 446/443

(58) Field of Search ..... 74/332, 342, 355, 74/376; 446/443, 456

(56) References Cited

U.S. PATENT DOCUMENTS

| | | | | | |
|---|---|---|---|---|---|
| 745,337 | A | * | 12/1903 | Fagerstrom | 74/376 |
| 1,059,434 | A | | 4/1913 | Butler | 74/344 |
| 1,319,246 | A | | 10/1919 | Riedele | 74/335 |
| 1,608,471 | A | | 11/1926 | Lascombes | 74/344 |
| 1,671,033 | A | | 5/1928 | Kimura | 74/355 |
| 1,801,658 | A | | 4/1931 | Campbell et al. | 74/355 |
| 1,947,847 | A | | 2/1934 | Harvey | 74/355 |
| 1,950,056 | A | | 3/1934 | Kressin | 74/355 X |
| 2,039,665 | A | * | 5/1936 | Rossetter | 74/376 |
| 2,225,174 | A | * | 12/1940 | Keller | 74/332 |
| 2,299,563 | A | | 10/1942 | Carlson et al. | 74/355 |
| 3,479,895 | A | | 11/1969 | Wegener | 74/355 |
| 4,730,505 | A | * | 3/1988 | Sumihi | 74/332 |
| 5,503,586 | A | * | 4/1996 | Suto | 446/443 |
| 5,862,705 | A | | 1/1999 | Lee | 74/344 X |
| 5,910,190 | A | | 6/1999 | Brookins | 74/355 X |
| 6,196,894 | B1 | | 3/2001 | Kennedy et al. | 446/461 |
| 6,386,058 | B1 | * | 5/2002 | Lui | 74/332 |

FOREIGN PATENT DOCUMENTS

| | | |
|---|---|---|
| NL | 100630 | 3/1962 |

* cited by examiner

*Primary Examiner*—Sherry Estremsky
(74) *Attorney, Agent, or Firm*—Ladas & Parry

(57) ABSTRACT

A forward/backward steering control mechanism installed in a toy car and coupled to a power drive and controlled by a remote controller to move the toy car forwards/backwards. The forward/backward steering control mechanism uses a remote controller-controlled server to move a movable gear on the transmission shaft of the toy car between a first transmission gear wheel, which is coupled to the power drive of the toy car, and a second transmission gear wheel, which is coupled to the first transmission gear wheel through two meshed idle gears, so as to control the direction of rotation of the transmission shaft, and to further control forward/backward movement of the toy car.

2 Claims, 5 Drawing Sheets

REMOTE-CONTROLLED TOY CAR FORWARD/BACKWARD STEERING CONTROL MECHANISM

BACKGROUND OF THE INVENTION

The present invention relates to a forward/backward steering control mechanism for a remote-controlled toy car, and more particularly to such a forward/backward steering control mechanism, which is installed in a toy car and coupled to a power drive and controlled by a remote controller to move the toy car forwards/backwards.

Regular remote-controlled gasoline engine toy cars can be controlled to move forwards as well as backwards. The forward and backward movement of a remote-controlled gasoline engine toy car is achieved by means of the operation of an auxiliary transmission mechanism. According to conventional designs, the forward transmission mechanism and the backward transmission mechanism of a remote-controlled gasoline engine toy car are separately operated, i.e., the player must operate the remote controller to drive the forward transmission mechanism, causing the forward transmission mechanism to move the toy car forwards. On the contrary, when moving the toy car backwards, the player must operate the remote controller to drive the backward transmission mechanism. Because two transmission mechanisms are needed, conventional remote-controlled gasoline engine toy cars are commonly heavy and expensive, and consume much gasoline during operation. In order to eliminate these drawbacks, the present inventor invented an improved transmission control design, entitled "Forward/backward steering control mechanism for a remote-controlled toy car", under patent application Ser. No. 09/660280. This structure of forward/backward steering control mechanism comprises a transmission shaft coupled between the front wheel system and rear wheel system of the toy car, a transmission wheel revolvably mounted on the transmission shaft and coupled to the power drive of the toy car, a first idle gear meshed with the transmission wheel, a second idle gear meshed with the first idle gear, a movable gear mounted on a polygonal segment of the transmission shaft and moved between a first position where the movable gear is meshed with an internal gear of the transmission wheel for enabling the transmission shaft to be rotated with the transmission wheel clockwise to move the toy car forwards, and a second position where the movable gear is disengaged from the transmission wheel and meshed with the second idle gear to rotate the transmission shaft counter-clockwise in moving the toy car backwards during rotary motion of the transmission wheel, and a server controlled by the remote controller to move the movable gear between the first position and the second position. This forward/backward steering control mechanism is functional, however its structure is still complicated.

SUMMARY OF THE INVENTION

It is the main object of the present invention to provide a remote-controlled toy bar forward/backward steering control mechanism, which uses a simple gear clutch structure to control switching between forward mode and backward mode of the remote-controlled toy car. The forward/backward steering control mechanism comprises a movable gear sliding on a transmission shaft and prohibited from rotary motion relative to the transmission shaft, a remote controller-controlled server adapted to move the movable gear on the transmission shaft between a first transmission gear wheel, which is coupled to the power drive of the toy car, and a second transmission gear wheel, which is coupled to the first transmission gear wheel through two meshed idle gears. The transmission shaft is rotated with the movable gear and the first transmission gear wheel to move the toy car forwards when the movable gear is moved into engagement with the first transmission gear wheel. The transmission shaft is rotated with the movable gear and the second transmission gear wheel to move the toy car backwards when the movable gear is moved into engagement with the second transmission gear wheel.

DETAILED DESCRIPTION OF THE PREFERRED EMBODIMENT

Figure 1:
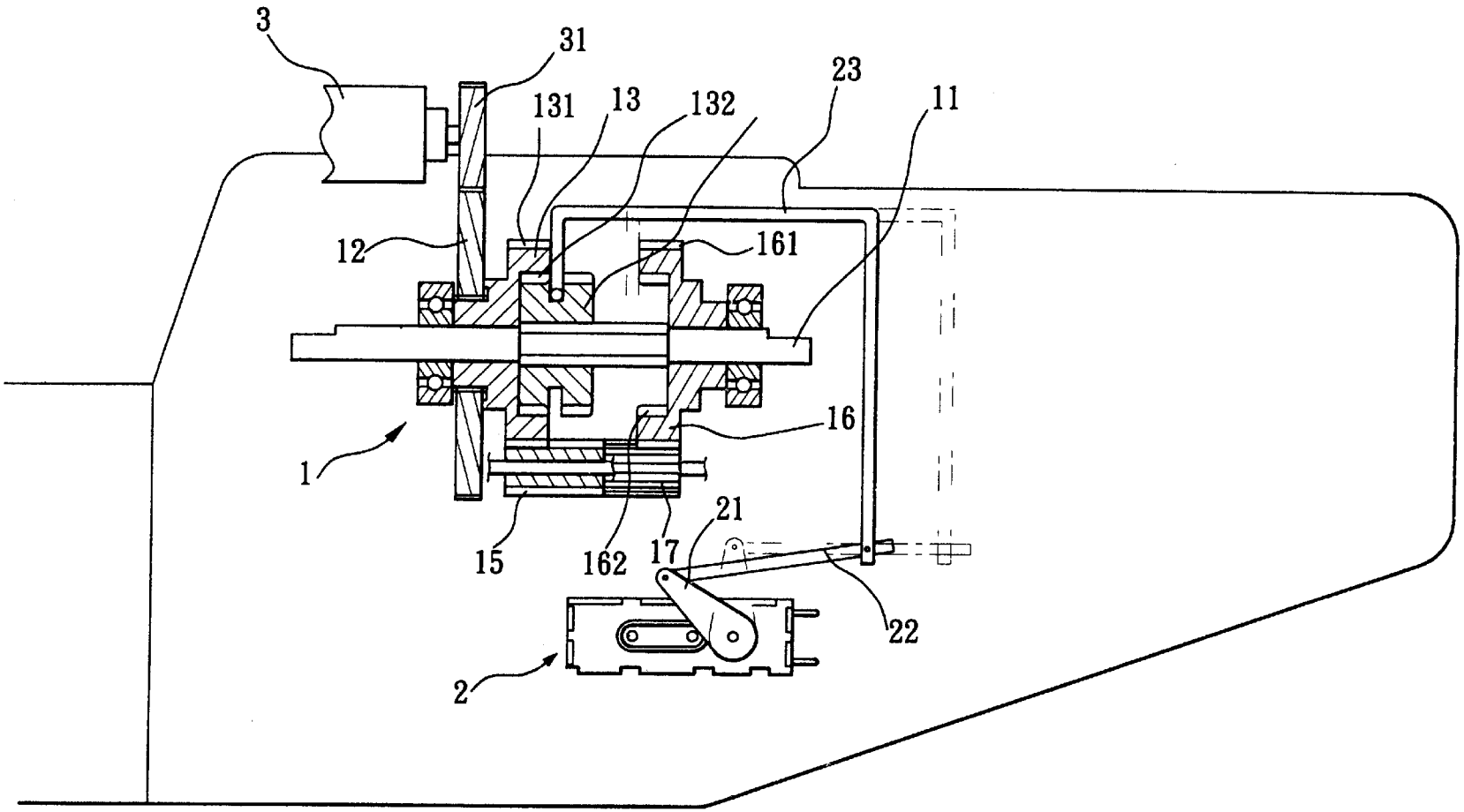
FIG. 1 is a plain view of a forward/backward steering control mechanism according to the present invention.
Figure 5:
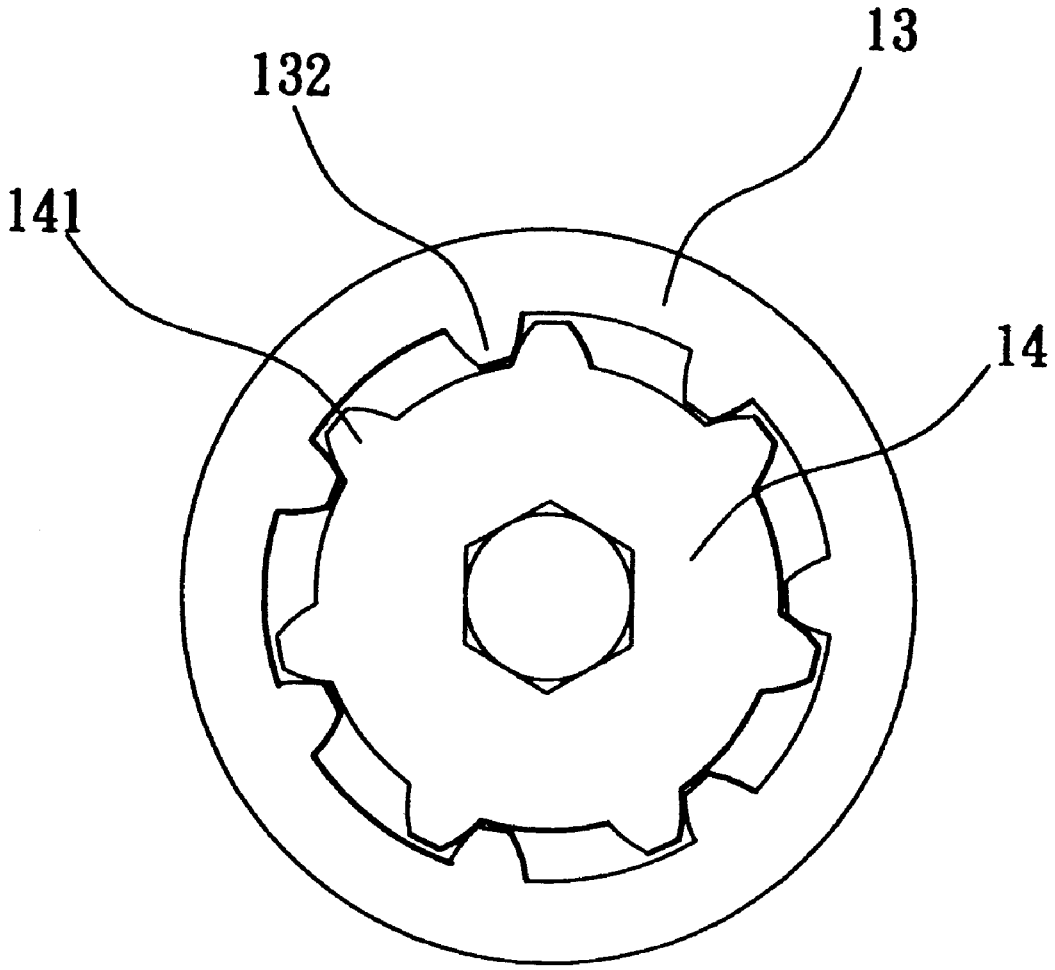
FIG. 5 is a plain view showing the teeth of the movable gear meshed with the internal gear of the first transmission gear wheel according to the present invention.

Referring to FIG. 1, a forward/backward steering control mechanism for a remote-controlled toy car is shown comprising a transmission shaft 11. The transmission shaft 11 is coupled between the front wheel system and rear wheel system (not shown) of the toy car and revolvably supported on bearings (not shown), having a polygonal segment 111. A first transmission gear wheel 13 and a second transmission gear wheel 16 are respectively revolvably mounted on the transmission shaft 11 at two sides of the polygonal segment 111. The transmission gear wheel 13 comprises an external gear 131 and an internal gear 132. The number of the internal gear 132 is 7. The second transmission gear wheel 16 comprises an external gear 161 and an internal gear 162. The number of the internal gear 162 is 7. A driven gear 12 is fixedly mounted on the first transmission gear wheel 13 for synchronous rotation. A driving gear 31 is coupled to the engine 3 of the toy car, and meshed with the driven gear 12. A movable gear 14 is longitudinally slidably mounted on the polygonal segment 111 of the transmission shaft 11, and prohibited from rotary motion relative to the transmission shaft 11 (the movable gear 14 has a polygonal center hole fitting the polygonal cross-section of the polygonal segment 111, so that the movable gear 14 is prohibited from rotary motion relative to the transmission shaft 11). The movable gear 14 comprises a series of teeth 141 around the periphery. The number of the teeth 141 is 7. The movable gear 14 can be moved along the polygonal segment 111 of the transmission shaft 11 between a first position where the teeth 141 are forced into engagement with the internal gear 132 of the first transmission gear wheel 13 for enabling the transmission shaft 11 to be rotated with the first transmission gear wheel 13, and a second position where the teeth 141 are disengaged from the internal gear 132 of the transmission wheel 13 and forced into engagement with the internal gear 162 of the second transmission gear wheel 16 (see FIG. 5) preventing a rotation of the transmission shaft 11 with the first transmission gear wheel 13. The tooth pitch of the first transmission gear wheel 13 and the second transmission gear wheel 16 is greater than the width of the teeth 141 of the movable gear 14, so that the teeth 141 of the movable gear 14 can easily be forced into engagement with the internal gear 132 or 162 when moving the movable gear 14 between the first position and the second position.

A first idle gear 15 is provided and meshed with the external gear 131 of the first transmission gear wheel 13. A second idle gear 17 is provided and meshed between the first idle gear 15 and the external gear 161 of the second transmission gear wheel 16.

The forward/backward steering control mechanism further comprises a server 2. The server 2 comprises a rocker arm 21. A first link 22 is coupled to the rocker arm 21. A second link 23 is coupled between the first link 22 and the movable gear 14.

Figure 2:
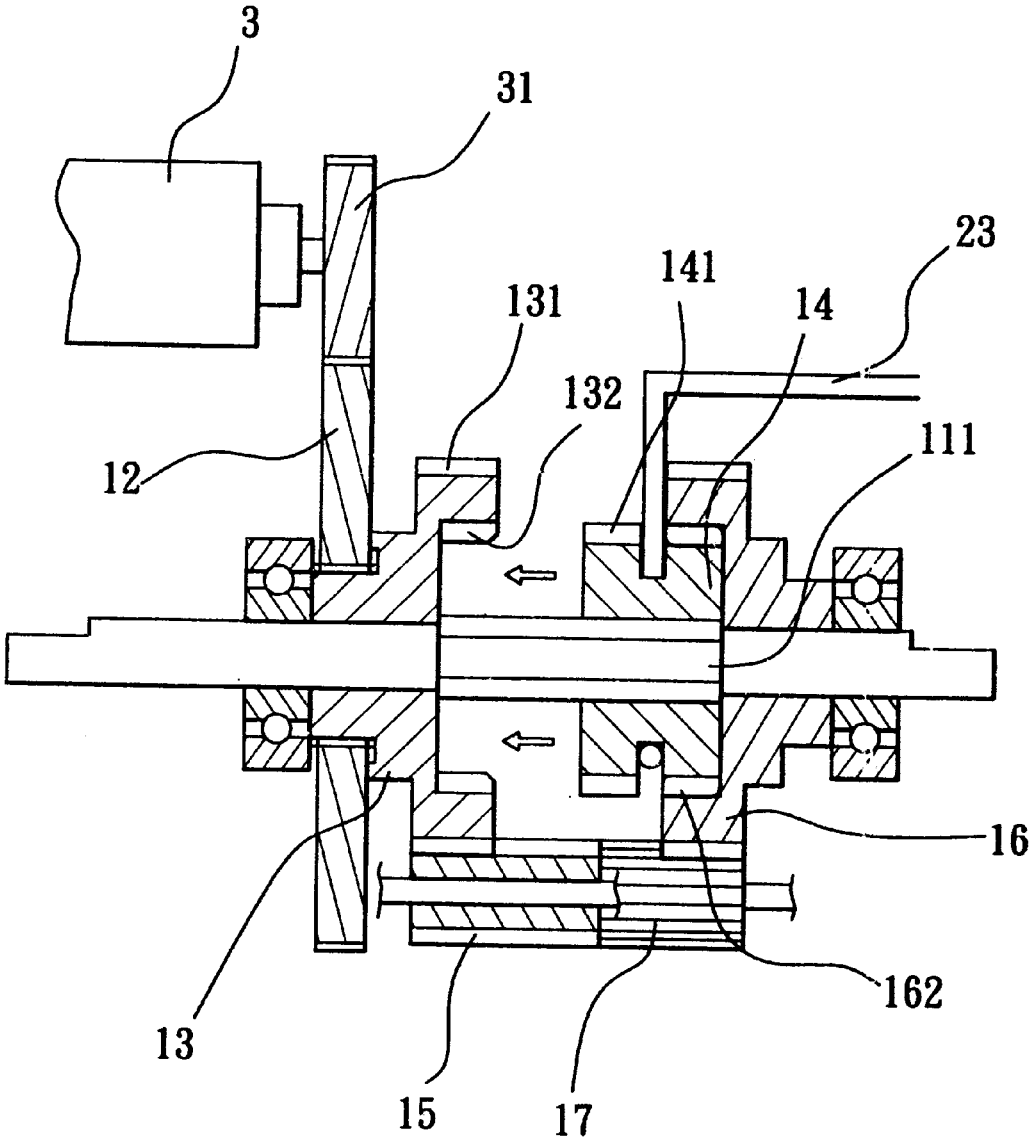
FIG. 2 is a sectional view showing the movable gear moved o the second position and meshed with the internal gear of the second transmission gear wheel according to the present invention.
Figure 3:
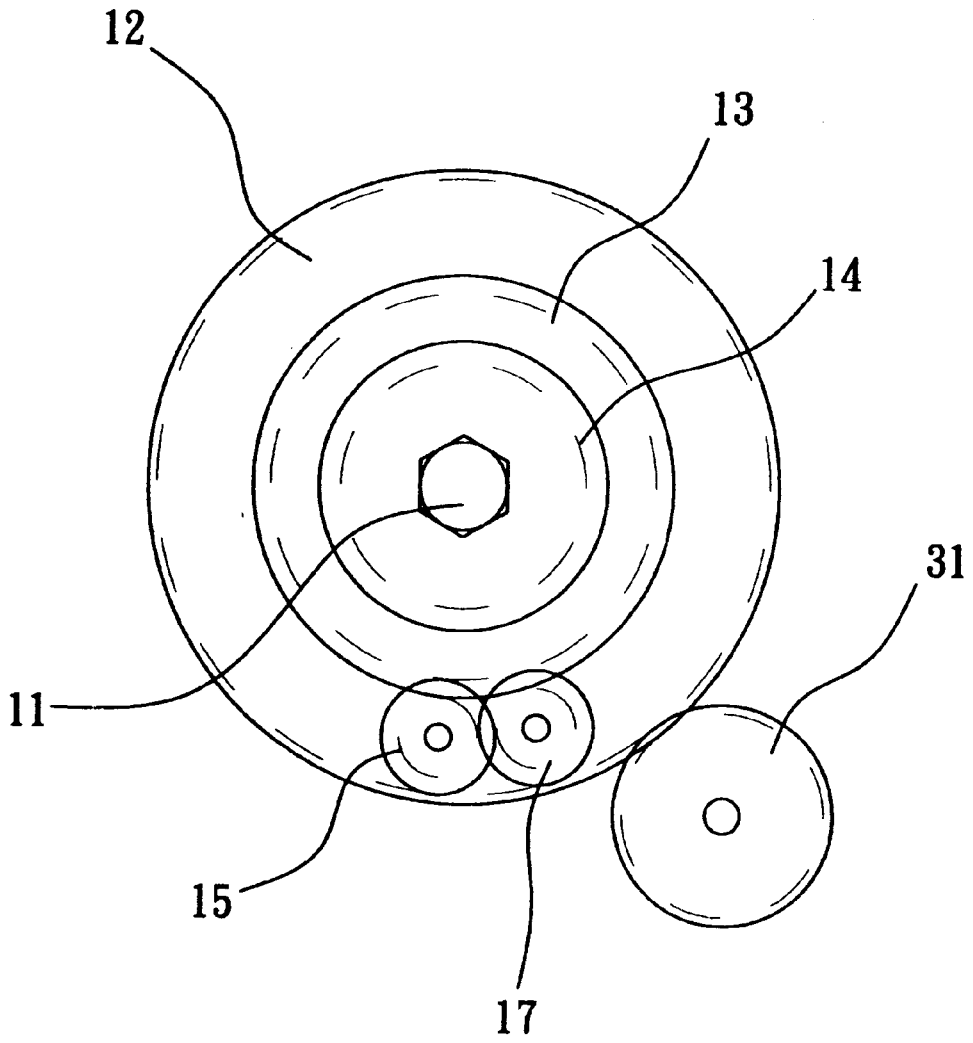
FIG. 3 is a side view of FIG. 2.
Figure 4:
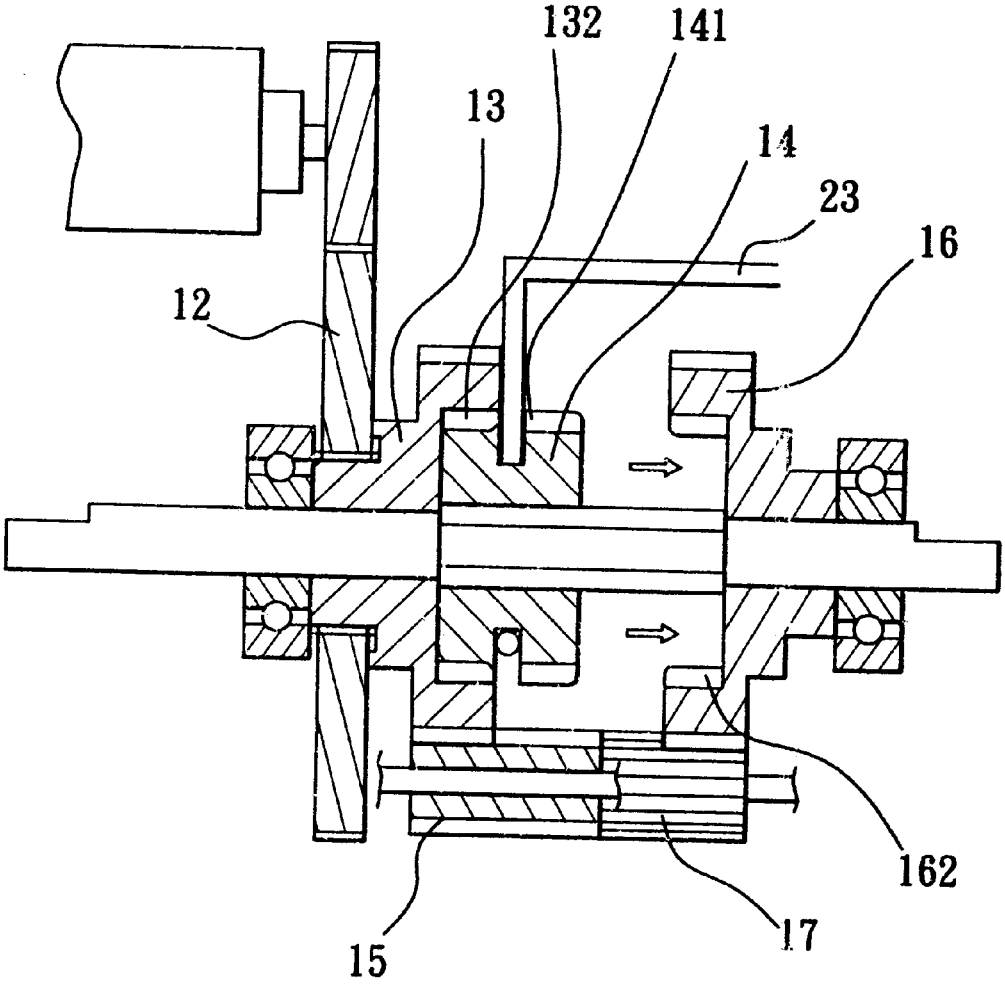
FIG. 4 is a sectional view showing the movable gear moved to the first position and meshed with the internal gear of the first transmission gear wheel according to the present invention.

Referring to FIGS. from 2 through 5, when in use, the user can operate the remote controller to control the server 2, causing the rocker arm 21 to be turned forwards or backwards. When turning the rocker arm 21 forwards, the first link 12 is moved forwards, causing the second link 23 to move the movable gear 14 from the first position shown in FIG. 1 to the second position shown in FIG. 2). On the contrary, when turning the rocker arm 21 backwards, the first link 12 is moved backwards, thereby causing the second link 23 to move the movable gear 14 from the second position to the first position. When starting the engine 3 to rotate the driving gear 31 after the movable gear 14 had been moved to the second position as shown in FIGS. 2 and 3, the driven gear 12 is driven by the driving gear 31 to rotate the first transmission gear wheel 13 clockwise, thereby causing the first idle gear 15 to be rotated counter-clockwise, and at the same time the second idle gear 17 is driven by the first idle gear 15 to rotate clockwise, causing the movable gear 14 to be rotated with the second transmission gear wheel 16 counter-clockwise, and therefore the transmission shaft 11 is rotated counter-clockwise to move the toy car backwards. On the contrary, when moving the movable gear 14 from the second position to the first position as shown in FIG. 1, the movable gear 14 is meshed with the internal gear 132 of the transmission wheel 13 and rotated with the transmission wheel 13 clockwise, thereby causing the transmission shaft 11 to be rotated with the movable gear 14 clockwise, and therefore the toy car is moved forwards, and at the same time the first idle gear 15, the second idle gear 17 and the second transmission gear wheel 16 run idle.

While only one embodiment of the present invention has been shown and described, it will be understood that various modifications and changes could be made thereunto without departing from the spirit and scope of the invention disclosed.

What the invention claimed is:

1. A remote-controlled toy car forward/backward steering control mechanism installed in a toy car and coupled to a power drive and controlled by a remote controller to move the toy car forwards/backwards, comprising:

a transmission shaft coupled between front wheel system and rear wheel system of the toy car, said transmission shaft comprising a polygonal segment;

a first transmission gear wheel revolvably mounted on said transmission shaft at one side of said polygonal segment, said transmission wheel comprising an external gear coupled to the power drive of the toy car, and an internal gear;

a second transmission gear wheel revolvably mounted on said transmission shaft at one side of said polygonal segment opposite to said first transmission gear wheel, said second transmission gear wheel comprising an external gear and an internal gear;

a first idle gear meshed with the external gear of said transmission wheel;

a second idle gear meshed between said first idle gear and the external gear of said second transmission gear wheel;

a movable gear mounted on the polygonal segment of said transmission shaft and moved along the polygonal segment of said transmission shaft between a first position where said movable gear is meshed with the internal gear of said transmission wheel for enabling said transmission shaft to be rotated with said first transmission gear wheel clockwise to move the toy car forwards, and a second position where said movable gear is disengaged from the internal gear of said transmission wheel and meshed with the internal gear of said second transmission gear wheel to rotate said transmission shaft counter-clockwise in moving the toy car backwards during rotary motion of said first transmission gear wheel; and a server controlled by the remote controller to move said movable gear between said first position and said second position, said server comprising link means coupled to said movable gear.

2. The remote-controlled toy car forward/backward steering control mechanism of claim 1, wherein the tooth pitch of said first transmission gear wheel and said second transmission gear wheel is greater than the width of the teeth of said movable gear.

* * * * *